US005422541A

United States Patent [19]

Tsuida

[11] Patent Number: 5,422,541

[45] Date of Patent: Jun. 6, 1995

[54] KLYSTRON TUNING MECHANISM HAVING MEANS FOR CHANGING THE PITCH OF AN INTERNAL THREADED PORTION

[75] Inventor: Shunji Tsuida, Tokyo, Japan

[73] Assignee: NEC Corporation, Japan

[21] Appl. No.: 49,128

[22] Filed: Apr. 19, 1993

[30] Foreign Application Priority Data

Apr. 20, 1992 [JP] Japan ..... 4-099061

[51] Int. Cl.[6] ..... H01J 23/20

[52] U.S. Cl. ..... 315/5.47; 315/5.48; 315/5.53; 315/5.54

[58] Field of Search ..... 315/5.46, 5.47, 5.48, 315/5.53, 5.54; 331/83; 330/45

[56] References Cited

U.S. PATENT DOCUMENTS

| | | | |
|---|---|---|---|
| 3,617,799 | 11/1971 | Schmidt et al. | 315/5.47 |
| 3,838,308 | 9/1974 | Merdinian et al. | 315/5.46 X |
| 3,987,332 | 10/1976 | Convery | 315/5.46 |
| 4,216,409 | 8/1980 | Sato et al. | 315/5.46 |
| 4,243,961 | 1/1981 | Faillon et al. | 333/233 |

FOREIGN PATENT DOCUMENTS

| | | | |
|---|---|---|---|
| 37539 | 2/1988 | Japan | 315/5.46 |

*Primary Examiner*—Benny T. Lee

*Attorney, Agent, or Firm*—Laff, Whitesel, Conte & Saret, Ltd.

[57] ABSTRACT

A klystron tuning mechanism includes a tuning element support mechanism, a preset section, a driving mechanism, and a pitch changing section. The tuning element support mechanism is arranged in a cavity resonator to be coupled to a tuning element, fixed in the cavity resonator, through bellows, and axially applies a biasing force to the tuning element. The preset section has a plurality of screw members axially positioned in accordance with preset tuning frequencies and selectively movable coaxially with the tuning element, and a preset plate having an internal thread portion meshed with the screw members. The preset section is retractably moved with respect to the tuning element support mechanism. The driving mechanism drives the preset section to retractably move so as to bring a selected one of the screw members into contact with the tuning element support mechanism against the biasing force, thereby positioning the tuning element to a preset position. The pitch changing section changes part of the pitch of the internal thread portion.

7 Claims, 2 Drawing Sheets

KLYSTRON TUNING MECHANISM HAVING MEANS FOR CHANGING THE PITCH OF AN INTERNAL THREADED PORTION

BACKGROUND OF THE INVENTION

The present invention relates to a klystron tuning mechanism and, more particularly, to a klystron tuning mechanism for amplifying a high frequency power in a millimeter frequency region.

A klystron is basically constituted by an electron gun section for generating and emitting an electron beam, a high-frequency circuit section for causing high-frequency power to interact with the electron beam, a collector section for catching the electron beam, and a focusing unit for focusing the electron beam passing through the high-frequency circuit section. The high-frequency circuit section is generally constituted by a plurality of cavity resonators. Each cavity resonator has a resonance cavity main body and a tuning element arranged in a resonance cavity to variably change the tuning frequency. The tuning element is connected/-supported to/by a tuning mechanism located outside the cavity resonator such that the element can be displaced in the resonance cavity.

In such a klystron, every time the frequency of high-frequency power to be amplified is changed, the tuning frequency must be adjusted to a proper value while the waveforms of outputs from the plurality of cavity resonators are observed. In order to solve the problem of difficulty in handling as compared with a traveling-wave tube designed to amplify a high frequency in a millimeter frequency region similar to the klystron, a preset mechanism section is arranged to allow the klystron to easily obtain a specified bandwidth by only performing a switching operation with respect to preset frequencies.

A conventional klystron tuning mechanism including such a preset mechanism section comprises a tuning support mechanism, a preset section, and a driving mechanism. The tuning support mechanism has a tuner shaft which is arranged coaxially with a tuning element and connected thereto to support the tuning element at a preset position. In this case, the tuning element is designed to change the tuning frequency by changing the volume of a resonance cavity. The preset section has a plurality of adjustment screws which are adjusted for preset frequencies in advance, and a preset plate which is caused to slide while the adjustment screws are supported thereon, thereby positioning a desired adjustment screw coaxially with the distal end portion of the tuner shaft. The driving mechanism causes the preset section to move forward and backward with respect to the tuning support mechanism so as to bring a selected adjustment screw into contact with the distal end portion of the tuner shaft.

In changing the tuning frequency, the driving mechanism causes the preset section to move backward from the tuning support mechanism so as to free the adjustment screw from the tuner shaft, with which the screw has been in contact, and the preset plate is caused to slide to position an adjustment screw set to a desired frequency to the distal end portion of the tuner shaft. Thereafter, the preset section is moved forward to the tuning support mechanism to be located at a predetermined lock position by the driving mechanism. With this operation, the adjustment screw is brought into contact with the distal end portion of the tuner shaft to push the tuner shaft, and a tuning element coupled to the tuner shaft is positioned to a predetermined position by the tuning support mechanism, thus switching the frequency.

As shown in FIG. 3, in order to prevent looseness of each adjustment screw 13 which is in contact with a distal end portion *7a* of a tuner shaft, a groove 13*a* is formed in the surface of each adjustment screw 13, and a Teflon member 28 is embedded in the groove 13*a* to be meshed with an internal thread portion 27 formed in preset section 11.

According to a tuning mechanism having this conventional structure, looseness of each adjustment screw 13 is caused by degradation of the Teflon member 28 due to repetitive rotation of the adjustment screw, which is performed for tuning frequency adjustment, and degradation of the Teflon member 28 over time. As a result, the tuning frequency of a cavity resonator deviates from an adjusted value, and the frequency characteristics of the klystron may greatly change within a period of time shorter than the specified service life of the klystron.

SUMMARY OF THE INVENTION

It is an object of the present invention to provide a klystron tuning mechanism which can stably maintain the frequency characteristics of a klystron over a long period of time.

It is another object of the present invention to provide a klystron tuning mechanism which prevents looseness of an adjustment screw for tuning frequency adjustment.

In order to achieve the above objects, according to the present invention, there is provided a klystron tuning mechanism comprising a tuning element support mechanism, arranged in a cavity resonator to be coupled to a tuning element, fixed in the cavity resonator, through bellows, for axially applying a biasing force to the tuning element, a preset section having a plurality of screw members axially positioned in accordance with preset tuning frequencies and selectively movable coaxially with the tuning element, and a preset plate having an internal thread portion meshed with the screw members, the preset section being retractably moved with respect to the tuning element support mechanism, a driving mechanism for driving the preset section to retractably move so as to bring a selected one of the screw members into contact with the tuning element support mechanism against the biasing force, thereby positioning the tuning element to a preset position, and pitch changing means for changing part of a pitch of the internal thread portion.

DESCRIPTION OF THE PREFERRED EMBODIMENTS

Figure 1A:
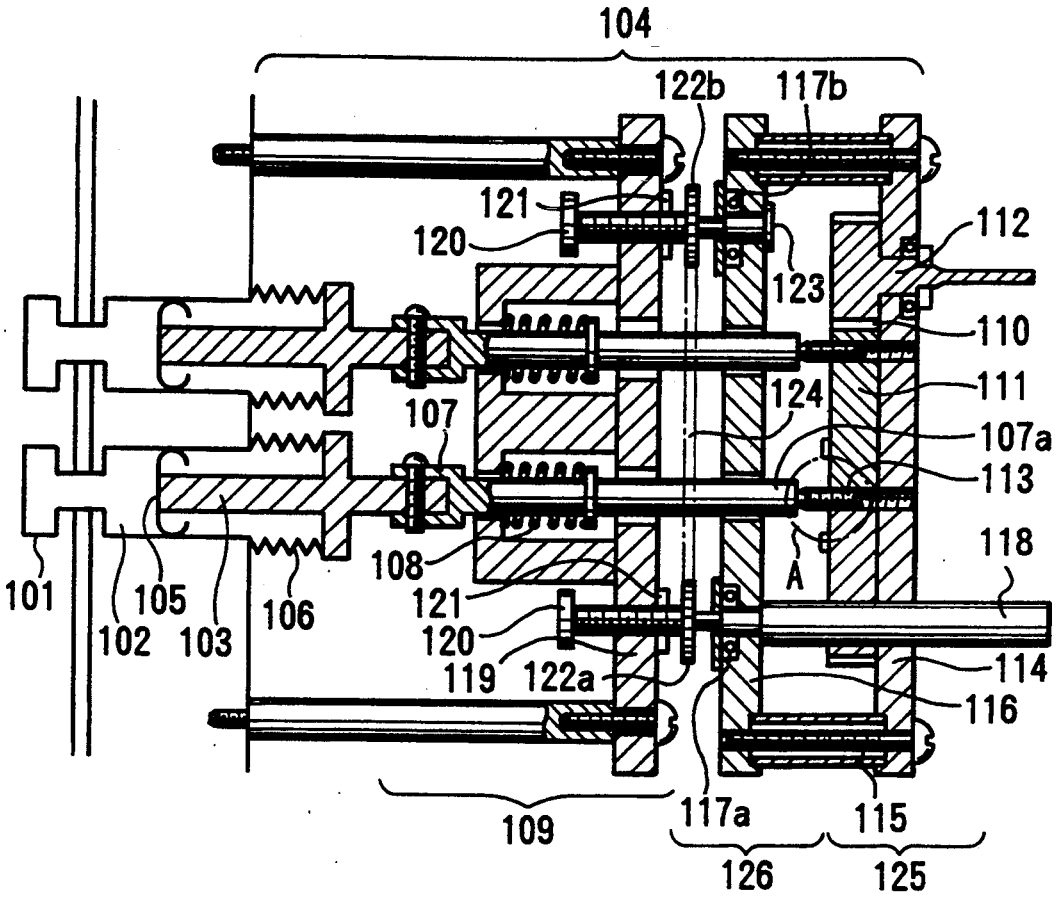
FIG. 1A is a sectional view of an embodiment of the present invention.
Figure 1B:
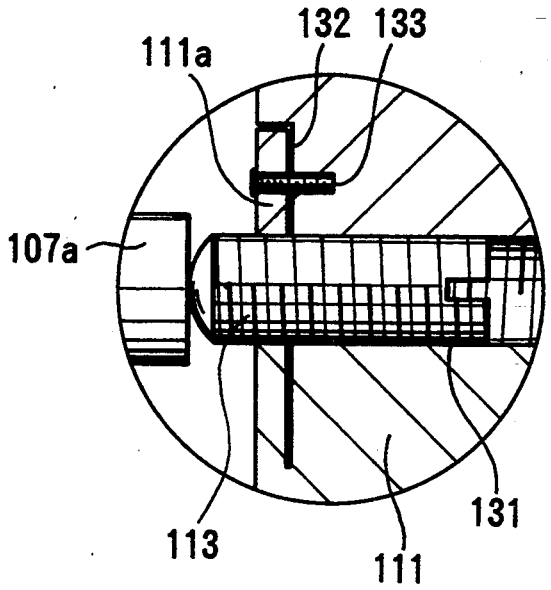
FIG. 1B is an enlarged view of a portion A in FIG. 1A.

FIG. 1A shows a klystron tuning mechanism according to an embodiment of the present invention. FIG. 1B shows a portion A in FIG. 1A. The same reference numerals are used to designate the same parts in FIGS. 1A and 1B. The overall arrangement of the klystron tuning mechanism will be described first. Each cavity resonator 101 has a tuning element 103 arranged in a resonance cavity 102 to variably change the tuning frequency by changing the volume of the resonance cavity. The tuning element 103 is connected/supported to/by a tuning mechanism 104 located outside the cavity resonator 101 such that the element is displaced in the resonance cavity 102. A bellows 106 is arranged between the outer wall of the resonance cavity 102 and a plunger 105 of the tuning element 103 so as to hold the klystron including the inside of the cavity resonator 101 in a vacuum state and allows displacement of the tuning element 103 upon mechanical deformation.

The tuning element 103 is connected/supported to/by a tuning element support mechanism 109 constituted by a tuner shaft 107 and a spring 108 for applying its own restoring force, as a force acting in the opposite direction to the atmospheric pressure, to the tuner shaft 107. In this case, the tuning element support mechanism 109 is connected/fixed to the outer wall of the resonance cavity 102 with, e.g., machine screws. A preset plate 111 coupled to a rack 110 is slid by rotating a change gear 112. A distal end portion 107*a*, of the tuner shaft 107, located on the opposite side to the tuning element 103, is in contact with one of adjustment screws 113 threadably engaged with the same surface of the preset plate 111. The degree to which each adjustment screw 113 is threadably engaged with the preset plate 111 is adjusted in advance to set the tuning element 103 in the cavity resonator 101 at a specific position through the tuner shaft 107, thereby allowing the cavity resonator 101 to obtain a specific tuning frequency. That is, a preset section 125 is constituted by a substrate 114 and the components disposed thereon, i.e., the preset plate 111, the rack 110, the adjustment screws 113, and the like.

A substrate 116 of a driving mechanism 126 is mounted on the substrate 114 of the preset section 125 through a collar 115 with machine screws or the like. A locking shaft 118 is rotatably mounted on the substrate 116 of the driving mechanism 126 through a bearing 117*a*. The locking shaft 118 is designed so as not to be axially displaced with respect to the substrate 116. A stationary plate 119 is fixed to the outer walls of the resonance cavities 102 at a fixed position with screws. A thread portion of the locking shaft 118 is threadably engaged with the stationary plate 119. An unlock plate 120 and a lock plate 121 are fixed to the two end portions of the engaged portion of the locking shaft 118. With this structure, by rotating the locking shaft 118, for example, the locking shaft 118 can be displaced in the reverse direction until the stationary plate 119 is brought into contact with the lock plate 121.

A sprocket 122*a* is fixed to the locking shaft 118. A locking screw 123 is rotatably mounted on the substrate 116 through a bearing 117*b*. The locking screw 123 is also designed so as not to be axially displaced with respect to the substrate 116. The locking screw 123 also has a portion threadably engaged with the stationary plate 119. An unlock plate 120 and a lock plate 121 are fixed to the two end portions of the engaged portion of the locking screw 123. A sprocket 122*b* is also fixed to the locking screw 123. A chain 124 is looped around the sprockets 122*a* and 122*b* so that the locking screw 123 is rotated, upon rotation of the locking shaft 118, through the chain 124. As a result, the substrate 116, i.e., the preset section 125, is translated toward or away from the stationary plate 119. That is, the overall preset section 125 can be vertically moved with respect to the stationary plate 119.

The tuning frequency of the klystron tuning mechanism having the above-described structure is performed as follows. In contrast to the illustration of FIG. 1A, the locking shaft 118 is rotated until the unlock plate 120 is brought into contact with the stationary plate 119 of the tuning element support mechanism 109. At this time, the rotational force of the locking shaft 118 is transmitted to the locking screw 123 through the sprocket 122*a*, the chain 124, and the sprocket 122*b*. Consequently, the preset section 125 is translated away from the stationary plate 119 of the tuning element support mechanism 109 together with the substrate 116. With this operation, the tuning element 103 and the tuner shaft 107 are restored to their original states by the biasing force of the spring 108. In addition, the adjustment screw 113 is set free from the distal end portion 107*a* of the tuner shaft 107. Thereafter, the preset plate 111 coupled to the rack 110 is slid parallel with the stationary plate 119 so as to cause another adjustment screw 113 set to a desired frequency to coincide with the axis of the tuner shaft 107. The locking shaft 118 is then rotated in the opposite direction (as shown in FIG. 1A) until the lock plates 121 of the locking shaft 118 and the locking screw 123 are brought into contact with the stationary plate 119 of the tuning element support mechanism 109. The tuner shaft 107 of the tuning element support mechanism 109, which is in contact with the adjustment screw 113 of the preset section 125, is pushed against the biasing force of the spring 108. With this operation, the tuning element 103 coupled to the tuner shaft 107 is positioned to a predetermined position, thereby switching the tuning frequency.

A characteristic feature of the present invention will be described next with reference to FIGS. 1A and 1B. A slit 132 for dividing an internal thread portion 131 into portions on the preset plate 111 side and the movable piece 111a side is formed in the preset plate 111 of the preset section 125 designed to set the tuning element 103 in the cavity resonator 101 at a specific position through the tuner shaft 107 to allow the cavity resonator 101 to obtain a specific tuning frequency. The preset plate 111 also includes a slit adjustment screw 133 for adjusting the width of the slit 132. A movable piece 111*a* has a thickness allowing it to be flexible so as to variably change the width of the slit 132. A fixed end side of the movable piece 111*a* is integrally cantilevered on the preset plate 111. The slit adjustment screw 133 is arranged on the free end side of the movable piece 111*a* so that the screw 133 can slightly move the movable piece 111a to change the width of the slit 132. By changing the width of the slit 132, the pitch of the internal thread portion 131 on the movable piece 111*a* side can be arbitrarily changed with respect to the pitch of the internal thread portion 131 on the preset plate 111 side.

In the mechanism having such an arrangement, the slit adjustment screw 133 is fastened to decrease the width of the slit 132 so as to change the pitch of the internal thread portion 131 on the movable piece 111*a* side, which is equal to the pitch of the internal thread portion 131 on the preset plate 111 side in the initial state. With this operation, the adjustment screw 113 is firmly meshed with the internal thread portion 131, especially the internal thread portion 131 on the movable piece 111*a* side, thereby preventing looseness of the adjustment screw 113 upon tuning frequency adjustment. The degree to which the adjustment screw 113 and the internal thread portion 131 are meshed with each other can be arbitrarily changed with the slit adjustment screw 133. Therefore, the adjustment screw 113 can be adjusted to a degree that the screw is not very firmly fastened in tuning frequency adjustment and is not loosened after tuning frequency adjustment.

In this embodiment, the initially set width of the slit 132 is decreased with the slit adjustment screw 133. However, the same effect can be obtained by increasing the width of the slit 132 by loosening the slit adjustment screw 133, if the movable piece 111*a* is designed to follow the advancing/retreating movement of the slit adjustment screw 133 in the two directions.

Figure 2:
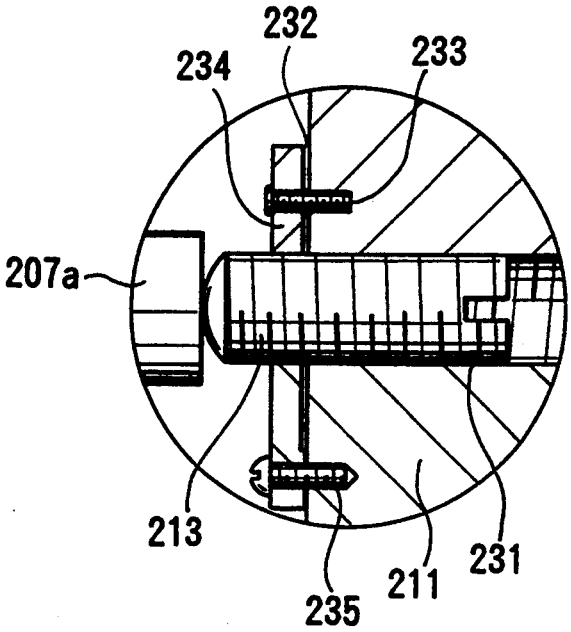
FIG. 2 is an enlarged view of a main part of an adjustment screw portion according to another embodiment of the present invention.
Figure 3:
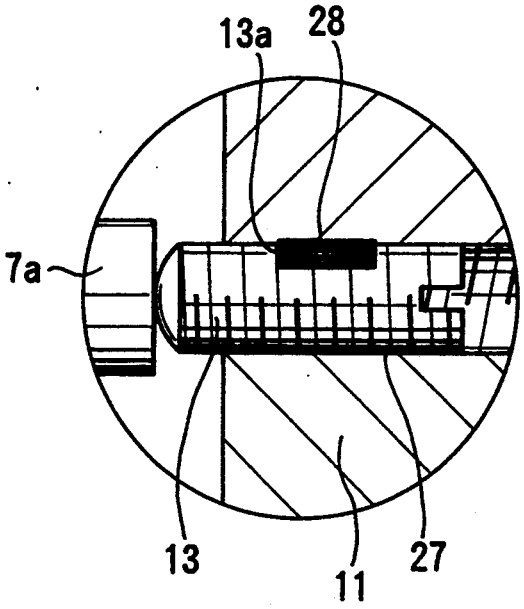
FIG.3 PRIOR ART
FIG. 3 is an enlarged view of a main part of a conventional adjustment screw portion.

FIG. 2 shows a main part of another embodiment of the present invention. Instead of integrally forming the movable piece 111*a* and the preset plate 111 as in the embodiment shown in FIG. 1B, a stepped movable plate 234 having an internal thread portion 231 is formed independently of a preset plate 211, and the fixed end, of the movable plate 234, which has a stepped portion, is fixed to the preset plate 211 with a screw 235. The movable end side of the movable plate 234 is slightly moved with a slit adjustment screw 233 to change the pitch of the internal thread portion 231. Reference numeral 207*a* denotes a distal end portion of a tuner shaft; 213, an adjustment screw; and 232, a slit. If an operation is performed such that the width of the slit 232 is increased, a flat plate without a stepped portion may be used as the movable plate 234. According to this embodiment, the preset plate 211 need not be moved, and formation of the slit 232 is greatly facilitated.

As has been described above, according to the present invention, looseness of an adjustment screw can be prevented because the meshed portion is free from degradation due to repetitive rotation of the adjustment screw, which is performed for tuning frequency adjustment, and from degradation over time. Therefore, a tuning mechanism for a high-power klystron can be realized, which can stably maintain the frequency characteristics of the klystron over a long period of time.

What is claimed is:

1. A klystron tuning mechanism comprising:

a tuning element disposed in a cavity resonator for variably changing a tuning frequency thereof by changing a volume of the cavity resonator;

a supporting mechanism for supporting said tuning element so as to be movable in a direction which changes the volume of the cavity resonator;

a screw member for actuating said tuning element to change the volume of the cavity resonator in accordance with a preset tuning frequency;

a preset plate having an internal thread portion engaged with said screw member, a degree to which said screw member is threadably engaged with said preset plate being preadjusted to set said tuning element at a preset position in the cavity resonator;

a biasing member for biasing said tuning element in a direction approaching a surface of said preset plate;

a driving mechanism for moving said preset plate toward said tuning element so as to set said tuning element at the preset position in the cavity resonator, said screw member projecting from said preset plate for actuating said tuning element against a biasing force of said biasing means when said preset plate is moved; and pitch changing means for changing part of a pitch of said internal thread portion so as to fix said screw member to said preset plate.

2. A klystron tuning mechanism comprising:

a tuning element disposed, in a cavity resonator for changing a tuning frequency thereof by changing a volume of the cavity resonator;

a supporting mechanism for supporting said tuning element so as to be movable in a direction which changes the volume of the cavity resonator;

a plurality of screw members for actuating said tuning element to change the volume of the cavity resonator in accordance with a preset tuning frequency;

a preset plate having a plurality of internal thread portions engaged with said screw member, a degree to which a plurality of said screw members are meshed with the internal threaded positions being independently adjustably in accordance with the preset tuning frequency;

a biasing member for biasing said tuning element in a direction approaching a surface of said preset plate;

a driving mechanism for moving said preset plate toward said tuning element so as to set said tuning element at the preset position in the cavity resonator, the driving mechanism driving the preset plate in a direction parallel to a surface thereof in order to select one of the internal thread portions actuating the tuning element, said screw member projecting from said preset plate for actuating said tuning element against a biasing force of said biasing means when said preset plate is moved; and pitch changing means for changing part of a pitch of said internal thread portion in order to fix said screw member to said preset plate.

3. A mechanism according to either claim 1 or claim 2, wherein said pitch changing means comprises a flexible member arranged on said preset plate through a slit and having part of said internal thread portion disposed thereon, and a slit adjustment member for changing a width of the slit by flexibly deforming said flexible member.

4. A mechanism according to claim 3, wherein said flexible member is a flexible plate having one end fixed to said preset plate, and said slit adjustment member comprises a slit adjustment screw on said preset plate so as to extend through another end of said flexible plate.

5. A mechanism according to claim 3, wherein said flexible member is arranged on a side of said preset plate adjacent said adjustment screw.

6. A mechanism according to claim 3, wherein said flexible member is constituted by a flexible piece integral with said preset plate and having a fixed end cantilevered on said preset plate, and said slit adjustment member is constituted by a slit adjustment screw on said preset plate so as to extend through a free end of said flexible piece.

7. A klystron tuning mechanism comprising:

a tuning element disposed in a cavity resonator for variably changing a tuning frequency thereof by changing a volume of the cavity resonator;

a supporting mechanism for supporting said tuning element so as to be movable in a direction which changes the volume of the cavity resonator;

a screw member for actuating said tuning element to change the volume of the cavity resonator in accordance with a preset tuning frequency;

a preset plate having an internal thread portion engaged with said screw member, a degree to which said screw member is threadably engaged with said preset plate being preadjusted to set said tuning element at a preset position in the cavity resonator;

a biasing member for biasing said tuning element in a direction approaching a surface of said preset plate;

a driving mechanism for moving said preset plate toward said tuning element so as to set said tuning element at the preset position in the cavity resonator, said screw member projecting from said preset plate for actuating said tuning element against a biasing force of said biasing means when said preset plate is moved;

pitch changing means for changing part of a pitch of said internal thread portion to fix said screw member to said preset plate, said pitch changing means being a flexible member separated at least in part from said preset plate by a slit and having part of said internal thread portion formed thereon;

said flexible member comprising a flexible piece which is integral with said preset plate and having a fixed end cantilevered on said preset plate;

a slit adjustment member for changing a width of the slit by flexibly deforming said flexible member, said slit adjustment member comprises a slit adjustment screw on said preset plate so as to extend through a free end of said flexible piece; and a tuner shaft which is movable in an axial direction thereof by the support mechanism, one end of said tuner shaft being connected to the tuning element and another end of said tuner shaft being in contact with a distal end of the screw member in order to transmit a position of the tuner shaft with respect to the internal thread portion in accordance with the movement of the preset plate relative to the tuning element as the preset position.

* * * * *